US010468780B1

(12) United States Patent
Milroy et al.

(10) Patent No.: US 10,468,780 B1
(45) Date of Patent: Nov. 5, 2019

(54) DUAL-POLARIZED FRACTAL ANTENNA FEED ARCHITECTURE EMPLOYING ORTHOGONAL PARALLEL-PLATE MODES

(71) Applicant: ThinKom Solutions, Inc, Hawthorne, CA (US)

(72) Inventors: William Milroy, Torrance, CA (US); William Henderson, Bedford, NH (US); James Sor, San Pedro, CA (US)

(73) Assignee: ThinKom Solutions, Inc., Hawthorne, CA (US)

( * ) Notice: Subject to any disclaimer, the term of this patent is extended or adjusted under 35 U.S.C. 154(b) by 0 days.

(21) Appl. No.: 16/113,129

(22) Filed: Aug. 27, 2018

(51) Int. Cl.
*H01Q 21/00* (2006.01)
*H01Q 21/06* (2006.01)

(52) U.S. Cl.
CPC ..... *H01Q 21/0031* (2013.01); *H01Q 21/065* (2013.01); *H01Q 21/0043* (2013.01); *H01Q 21/0075* (2013.01)

(58) Field of Classification Search
CPC ..... H01Q 21/00–068; H01Q 3/24–26
USPC ..... 343/770, 853, 893
See application file for complete search history.

(56) References Cited

U.S. PATENT DOCUMENTS 7,466,281 B2 * 12/2008 Haziza ..... H01Q 3/22 343/772
9,735,475 B2 * 8/2017 Anderson ..... H01Q 21/0093
2018/0366837 A1 * 12/2018 Fox ..... H01Q 21/064

* cited by examiner

*Primary Examiner* — Dameon E Levi
*Assistant Examiner* — Hasan Z Islam
(74) *Attorney, Agent, or Firm* — Kusner & Jaffe

(57) ABSTRACT

A multi-polarized continuous transverse stub (CTS) antenna includes a first feed network operative to at least one of receive or transmit a signal having a first polarization, and a second feed network different from the first feed network and operative to at least one of receive or transmit a signal having a second polarization different from the first polarization. At least one parallel-plate region is defined by a first plate structure and a second plate structure spaced apart from the first plate structure, where a first coupling structure connecting the first feed network to the parallel-plate region and a second coupling structure connecting the second feed network to the parallel-plate region. A common aperture is arranged on one side of the parallel-plate region, wherein wavefronts produced by the first and second coupling structures and propagated within the parallel-plate region radiate to free-space through the common aperture.

15 Claims, 10 Drawing Sheets

DUAL-POLARIZED FRACTAL ANTENNA FEED ARCHITECTURE EMPLOYING ORTHOGONAL PARALLEL-PLATE MODES

TECHNICAL FIELD

This present invention relates generally to antennas and, more particularly, to a Continuous Transverse Stub antenna that employs orthogonal parallel-plate modes to generate dual-polarized, dual frequency bands.

BACKGROUND ART

Today's communications world requires moving ever increasing amounts of data and bandwidth. This additional bandwidth comes at a price premium since network operators base their rates on the amount of spectrum utilized by their customers. To realize additional bandwidth or capacity, conventional systems will often use physically larger and larger antennas and/or separate apertures. The larger an antenna installation becomes, the larger the upfront and operational costs become.

The need to add additional antenna bandwidth without commensurately growing antenna footprint has always been and will continue to be a huge challenge. In today's world, it's not always enough to provide just full duplex Rx and Tx operation. It has increasingly become more important to design systems capable of operating across multiple bands and polarizations, while doing so within a constrained footprint.

SUMMARY OF INVENTION

Continuous Transverse Stub (CTS) antennas are a class of antennas that provide excellent radiation characteristics including high efficiency, low-profile, and low-cost construction. Although CTS technology itself is not new, CTS radiators are natively single-polarization and single-band devices.

A device in accordance with the present invention extend CTS technology in a new way by combining two single-polarization CTS antennas into a shared aperture volume. Separate RF channel structures within the CTS antenna are integrated together in a novel way to permit orthogonal dual channel operation using a common shared aperture. This integrated architecture doubles the RF bandwidth and permits dual-polarization, dual-band operation without any added penalty in size/footprint. The resulting unison of CTS technology with extended polarization and frequency channels leads to significant benefits in cost, size, and efficiency over existing dual-polarization/dual-band antenna architectures.

According to one aspect of the invention, a multi-polarized continuous transverse stub (CTS) antenna includes: a first feed network operative to at least one of receive or transmit a RF signal having a first linear polarization; a second feed network oriented geometrically orthogonal from the first feed network and operative to at least one of receive or transmit an RF signal having a second linear polarization, generally with an orthogonal polarization relative to the first polarization; at least one parallel-plate region defined by a first plate structure and a second plate structure spaced apart from the first plate structure; a first coupling structure connecting the first feed network to the parallel-plate region; a second coupling structure connecting the second feed network to the parallel-plate region; and a common aperture arranged on one side of the parallel-plate region, wherein generally orthogonal wavefronts produced by the first and second coupling structures and propagated within the parallel-plate region radiate to free-space through the common aperture.

In one embodiment, the CTS antenna further includes a plurality of pucks spaced apart from one another, wherein the space between adjacent pucks defines the common aperture.

In one embodiment, the plurality of pucks comprise a plurality of metallic members arranged in a lattice.

In one embodiment, the plurality of pucks are rectangular in shape.

In one embodiment, at least one puck of the plurality of pucks is dimensioned different from at least one other puck of the plurality of pucks.

In one embodiment, the first and second coupling structures are connected to the parallel-plate region on a side of the parallel-plate region opposite the common aperture.

In one embodiment, the first and second coupling structures are coupled to the second plate structure, and the common aperture is formed in the first plate structure.

In one embodiment, the parallel-plate region comprises a plurality of parallel plate regions located between the common aperture and the first and second coupling structures, whereby each adjacent parallel plate region further couples the wavefronts within such parallel-plate region to the next adjacent parallel plate region via parallel plate layer transitions.

In one embodiment, the CTS antenna further includes a polarizer arranged adjacent to the common aperture and operative to change a polarization of the radiated antenna patterns.

In one embodiment, the at least one parallel-plate region comprises a dielectric material arranged between the first plate structure and the second plate structure.

In one embodiment, the dielectric material comprises at least one of a foam material or air.

In one embodiment, the first feed network and the second feed network comprise at least one of a waveguide, a strip line, a suspended air stripline, or a microstrip transmission line.

In one embodiment, the first and second coupling structures comprise waveguide-to-parallel-plate slot transitions.

In one embodiment, the first polarization comprises vertical polarization and the second polarization comprises horizontal polarization.

In one embodiment, the parallel-plate region comprises at least one groove arranged in a surface of one of the first plate structure or the second plate structure.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, like references indicate like parts or features.

DETAILED DESCRIPTION OF INVENTION

Figure 1:
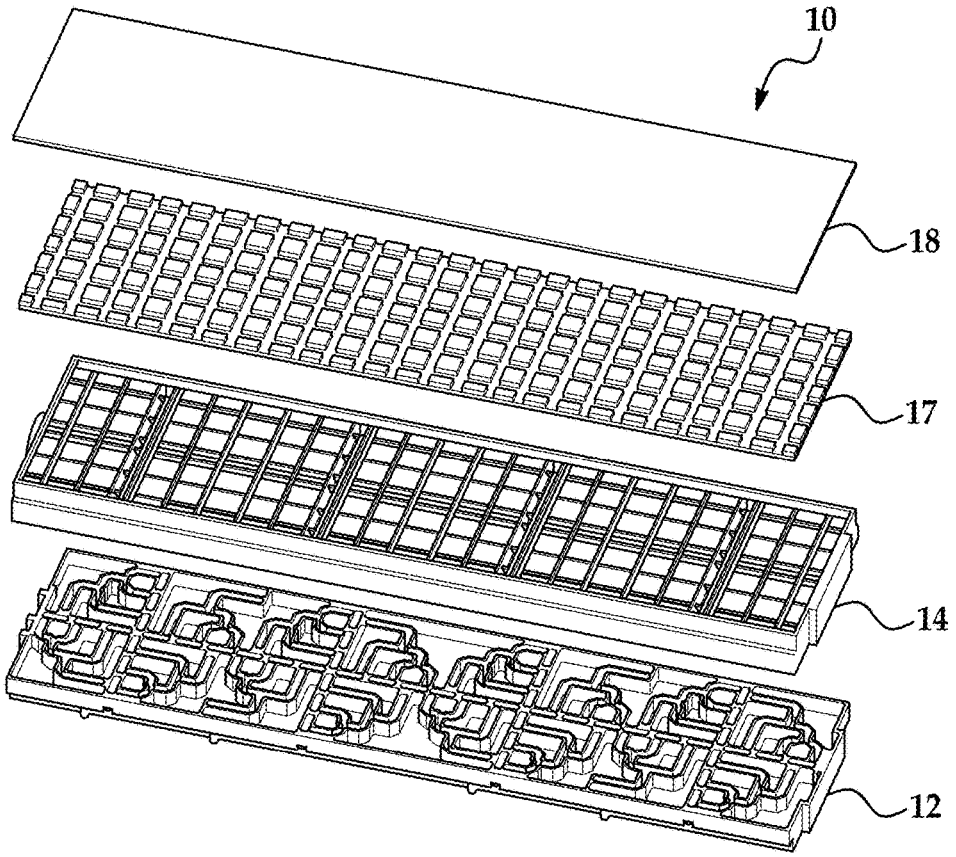
FIG. 1 is an exploded view of an exemplary dual polarization, dual frequency band CTS antenna in accordance with the invention.

An antenna in accordance with the present invention utilizes CTS technology to provide improved performance efficiencies and greater integration potential than conventional antenna elements. An antenna employing a CTS structure can make full use of a common active antenna area while supporting both Tx and Rx operating bands, leading to improved area efficiency, narrower antenna beamwidths and better adjacent satellite interference (ASI) performance. Further, CTS radiating and feeding structures are scalable in size to cover wideband frequency spectrums as needed. CTS antenna technology also enables cleaner, grating-lobe-free radiation patterns that can help reduce ASI.

Most antenna platforms are space-constrained and thus stacking separate Tx and Rx antennas to fit within a given footprint often leads to shadowing effects and integration issues. The poor area utilization arising from stacked or separate apertures also can lead to reduced antenna gain, larger GeoPlane beamwidths, and ultimately poorer ASI performance.

There are a number of ways to achieve dual-polarization (referred to as dual-pol)/dual frequency band (referred to as dual-band) operation. Some examples include:

dual-pol/dual-band horn array
dual-pol patch array
dual-pol/dual-band slot array
dual-pol/dual-band feed/reflector
separate (stacked or side-by-side) Tx and Rx subarrays Prior technologies, such as the architectures described above, are based on conventional, well established antenna elements (horns, patches, etc.) that are well understood and characterized. Conventional dual-pol/dual-band architectures all have various limitations in terms of performance, packaging, or cost, some of which are discussed below, that a dual-pol/dual-band CTS-based antenna in accordance with the invention can improve on.

For example, dual-pol/dual-band horn arrays can suffer from poor efficiency and limited bandwidth. In particular, the finite size of the horn radiators in an array can lead to spacing issues and grating lobe artifacts in the intercardinal planes. In contrast, CTS-based antennas offer cleaner radiation patterns that are free of grating lobe artifacts in the intercardinal planes, avoiding potential ASI issues that limit geographical coverage issues with some horn arrays.

Dual-pol patch arrays are inherently inefficient since they often employ microstrip, stripline, and other printed circuit technologies. This inefficiency is amplified since the lossy media are used in both the aperture and combining feed network. While patches are relatively straightforward and simple to design, they are narrowband (~few percentage bandwidth) and suffer from poor cross-pol over frequency. CTS-based antenna equivalents offer superior efficiency due to the low-loss transmission media used in all stages of the antenna's signal path. CTS radiators offer much broader bandwidth (up to 15%), and as discussed below can be grown to accommodate even wider spectrum requirements, for example, by adding additional levels (e.g., additional parallel-plate levels).

Dual-pol/dual-band slot arrays are expensive to fabricate, often requiring precision machining processes to tune the resonant slots. Like patches, slots are inherently narrowband radiators with poor efficiency. In contrast, CTS structures are not a resonant-type radiator, and thus offer much more bandwidth than slot type radiators. CTS structures offer improved radiation efficiency and can be easily adapted to volume manufacturing techniques (e.g., plastic injection mold stamping) that may not be suited for slot arrays.

Dual-pol/dual-band feed/reflector-based systems can be extremely bulky. For example, a common method to simultaneously provide two channels (Rx and Tx) and two polarizations (horizontal and vertical) in feed/reflector-based systems is to pair the reflector dish with a circular horn and an ortho-mode transducer (OMT). These components add additional bulk, so such systems are impractical for low-profile, low-drag applications. In contrast, CTS antenna structures can be highly integrated together into a true shared aperture, enabling these antennas to fit into much smaller volumes & footprints. Further, reflector-based systems suffer from unwanted spillover losses and poor aperture excitation control compared to CTS antennas. CTS structures offer better aperture distribution control by giving the designer much more direct freedom in designing its constituent parts (feed, tuners, spacings, radiators, etc.).

A CTS antenna array typically includes two plates, one (upper) having a one-dimensional lattice of continuous radiating stubs and a second (lower) having one or more line sources emanating into the parallel-plate region formed and bounded between the upper (first) and lower (second) plate structures. Accordingly, the radiating stub aperture of the conventional CTS antenna is comprised of a collection of identical, parallel, uniformly-spaced radiating stubs over its entire surface area. The stub aperture serves to couple energy from the parallel-plate region, which is formed between the upper-most conductive surface of the array network and the lower-most conductive surface of the radiating stub aperture structure.

A CTS antenna in accordance with the invention utilizes a novel architecture employing orthogonal parallel-plate modes to generate dual-polarized antennas. A dual-pol, dual-band CTS antenna in accordance with the present invention offers superior RF radiation performance (in terms of efficiency and pattern quality) at reduced footprints (up to half the space of separate Rx & Tx apertures). Such a dual-pol CTS antenna can utilize a highly integrated antenna architecture to enable dual-pol, dual-band operation using a single shared aperture. The internal parts that make up the CTS antenna can be built using techniques that allow for large volume manufacturing techniques, greatly reducing upfront hardware costs.

The above features have numerous practical benefits for terrestrial, ground-to-air, and SATCOM applications. For example, the smaller footprint/volume afforded by a dual-pol, dual-band CTS antenna in accordance with the invention enables more antennas to be installed on ground towers, on ships/planes/trains, and on satellite payloads. These installation sites are often cluttered where space comes at a price premium. The reduced footprint would enable lower profile Az/El COTM (communication on the move) terminals leading to simpler radome housings, and improved aerodynamics for vehicular-based terminals. Aeronautical COTM terminals would benefit from reduced drag leading to better fuel efficiency. Additionally, network operators can lower their operational expenses (OPEX) and improve quality of service (QOS) by taking advantage of CTS antennas' better efficiency and cleaner radiation patterns. For satellites operating in the geosynchronous satellite plane (GeoPlane), CTS' improved pattern qualities would reduce ASI which may plague other antenna technologies.

Referring to FIG. 1, illustrated is an exemplary construction and makeup of a dual-pol, dual-band CTS antenna 10 in accordance with the invention, showing its four primary regions. The antenna 10 includes two waveguide feed paths that make up a feed network 12 (region #1), each carrying a separate signal for one of two polarizations. The waveguide feed paths 12 help launch two orthogonal wavefronts into a dielectric filled structure called the parallel plate 14 (region #2). Above the parallel plate 14 sits an array of CTS radiators 17 (region #3) which help radiate the two orthogonal wavefronts to free-space. As used herein, a puck is defined as an RF conductive part or element, generally cuboid in shape or composed of multiple cuboids, that when appropriately spaced from and arrayed with other pucks, form orthogonal CTS radiators or orthogonal parallel plate transmission lines in the regions between them. A puck can be constructed from metal, metalized plastic, or other solid material as long as all external surfaces are RF conductive. An optional polarizer 18 (region #4) then matches the antenna's natural polarization to that of a satellite or other communication link. This novel architecture enables dual-pol, dual-band operation using a single shared aperture with low-loss, low profile characteristics. Details of the operation of all four regions of the dual-pol CTS antenna are provided below.

Figure 2:
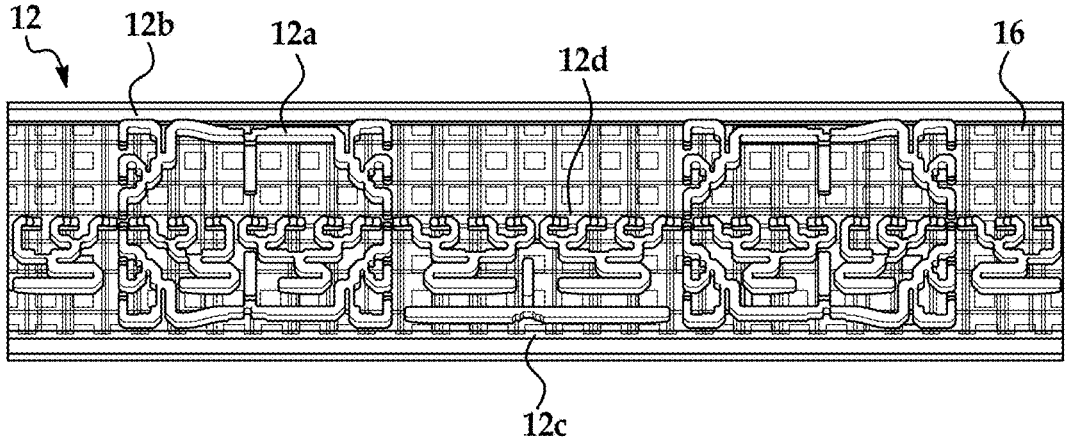
FIG. 2 is a top-level view illustrating an exemplary feed network for the antenna of FIG. 1, including waveguide-to-parallel plate slot transitions.

The feed network 12 makes up the first region in a dual-pol CTS antenna 10 and its function is to guide an input RF signal and efficiently transition it into the parallel plate 14. An exemplary Ku-Band feed with two separate waveguide feed networks, one for vertical and one for horizontal polarization, is shown in FIG. 2. The transmission line medium for the two separate feed paths is carefully laid out to avoid running into each other and thus may span more than one level. A waveguide is the preferred transmission line medium for dual-pol CTS antennas in order to facilitate the lowest transmission loss possible, although other transmission line media may be used, such as, for example, a strip line (e.g., a dielectric material arranged between two strip line segments), suspended-air strip line (e.g., a rectangular coax configuration), microstrip transmission line (e.g., transmission lines arranged on a single substrate), etc.). The detailed design of the feeds including their layout, power splits, and tuners may be implemented with the goal of launching a particular amplitude/phase distribution into the parallel plate 14. Considerations include the desired radiated antenna patterns, operating frequency bandwidth(s), modal dispersion effects and mitigation of those effects via feed network pre-distortion. These considerations are generally applied to each of the two orthogonal planes, separately. The particular distribution will depend on whether the antenna 10 is being used for Rx or Tx applications, the bandwidth needed, and volume/footprint constraints.

Figure 3:
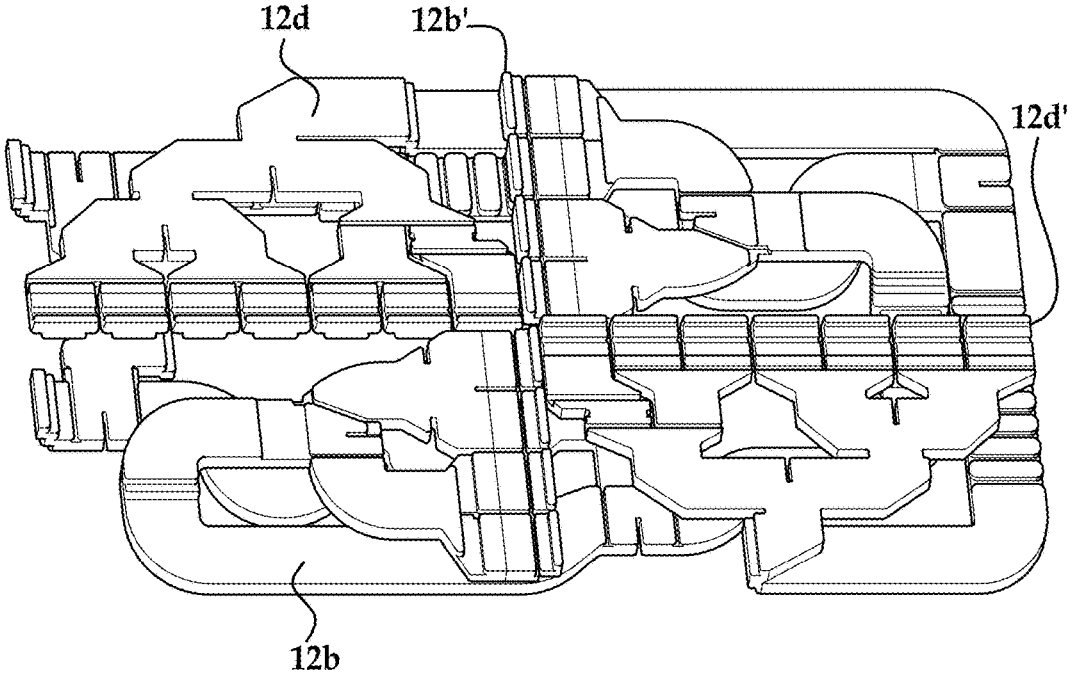
FIG. 3 is a detailed view of exemplary waveguide-to-parallel plate slot coupling transitions for an H-Plane feed network that may be utilized in the antenna of FIG. 1.

The transition from the input waveguide feed network 12 into the parallel plate 14 can be accomplished in several different ways, depending on the type of waveguide feed network that is utilized. FIG. 2 shows first and second coupling structures 12*b* (Hpol) and 12*d* (Vpol) coupling the first and second feed networks 12*a*, 12*c*, respectively, to the parallel-plate region (the second feed network may be oriented geometrically orthogonal relative to the first feed network). In the exemplary embodiment, the coupling structures are connected to the parallel-plate region on a side of the parallel-plate region opposite the aperture (the coupling structures are coupled to the lower (second) plate structure and the aperture is formed on the upper (first) plate structure). In one embodiment, the coupling structures 12*b* and 12*d* include waveguide-to-parallel plate slot transitions 12*b*', 12*d*' (see FIG. 3) that help transition energy from E-plane type waveguide feed networks to parallel plate. The waveguide-to-parallel plate slot transitions 12*b*' 12*d*' may be formed as groupings of slots that are fed symmetrically but feed slots that are oriented asymmetrically (i.e., in the same direction). As compared to conventional symmetric (E-plane) waveguide power-splitters with symmetrically-oriented feed slots, the asymmetric orientation has the advantage of resolving/correcting the inherent 180° phase offset associated with the conventional approach. A recessed trough at the base of a dielectric (not shown) in the parallel plate 14 allows evanescent energy to die down and can help suppress undesired modes that may arise when launching into denser dielectric materials.

Regardless of the type of feed network employed, the layouts and orientations of the first and second coupling structures 12*b*, 12*d* (and if utilized the waveguide-to-parallel plate slot transitions 12*b*' 12*d*') are carefully managed so that fields launched into the parallel plate 14 are properly phased together. For example, the coupling structures 12*b*, 12*d* and/or the waveguide-to-parallel plate slot transitions 12b' 12d' are laid out and oriented such that the various fields launch pre-distorted within the parallel plate 14 and become undistorted upon reaching the radiators 16. Based on the finite width of the parallel-plate region, operating frequency band, and RF path-length from the feed to the RF radiators, a conjugate-phase technique is employed to pre-distort the amplitude and phase profile of the launched wave (modes) at the feed such that, based on known dispersion effects, an undistorted (ideal amplitude and phase) profile is radiated at the aperture.

Referring back to FIG. 2, five different sections of the feed network 12 are illustrated. More specifically, a first-polarization (hereinafter first-pol) waveguide feed network 12a receives or transmits a first signal having a first linear polarization (e.g., Hpol). The first-pol waveguide feed network 12a may be a conventional waveguide that confines the wave to propagate in one or two dimensions, so that, under ideal conditions, the wave loses no power while propagating therethrough. For example, if the feed network 12a is in the form of a rectangular waveguide, then it may include top, bottom, left and right side walls that define a path that confines the signal within the defined path. Other waveguide shapes may be employed, such as waveguides having a circular or oval cross-section, without departing from the scope of the invention. The first-pol waveguide feed network 12a feeds the signal to the first coupling structure 12b which provides the signal to the parallel plate region 2. The first-pol waveguide 12a and the first coupling structure 12b (and the first waveguide-to-parallel plate slot transition 12b', if present) correspond to a first polarization (e.g., Hpol) of a signal to be injected into the parallel plate 14.

Similarly, the feed network 12 also includes a second linear polarization (hereinafter second-pol) waveguide feed network 12c (different from the first feed network), which receives or transmits a second signal having a second polarization that is substantially orthogonal to the first signal (e.g., Vpol). As used herein, substantially orthogonal is defined to be within fifteen degrees of perfect orthogonality, and more preferably within five degrees of perfect orthogonality. The second-pol waveguide feed network 12c is similar in construction to that of the first-pol waveguide feed network 12a, but is arranged such that the waveguide feed networks 12a, 12c do not intersect each other, i.e., they do not share a common/same waveguide path. The second-pol waveguide feed network 12c feeds the signal to the second coupling structure and 12d (and the second waveguide-to-parallel plate slot transition 12d', if present). The second-pol waveguide 12c and second coupling structure 12d (and second waveguide-to-parallel plate slot transition 12d', if present) correspond to a second polarization (e.g., Vpol) of a signal to be injected into the parallel-plate 14.

Energy from the second coupling structures 12b, 12d emerge into the parallel plate 14 (region #2), which may be regarded as a shared depository region. This region is typically constructed using a low-density material, such as foam, but may be homogeneously or inhomogeneously filled with alternate materials, including air. The low-density material provides mechanical support for the CTS radiator pucks 16 sitting directly above the parallel plate 14. The first and second waveguide feed structures 12b, 12d help transition energy from the waveguide feed networks 12a, 12c into two separate sets of orthogonal over-moded wavefronts inside the parallel-plate 14, and the wavefronts propagate through the parallel-plate 14.

Figure 4:
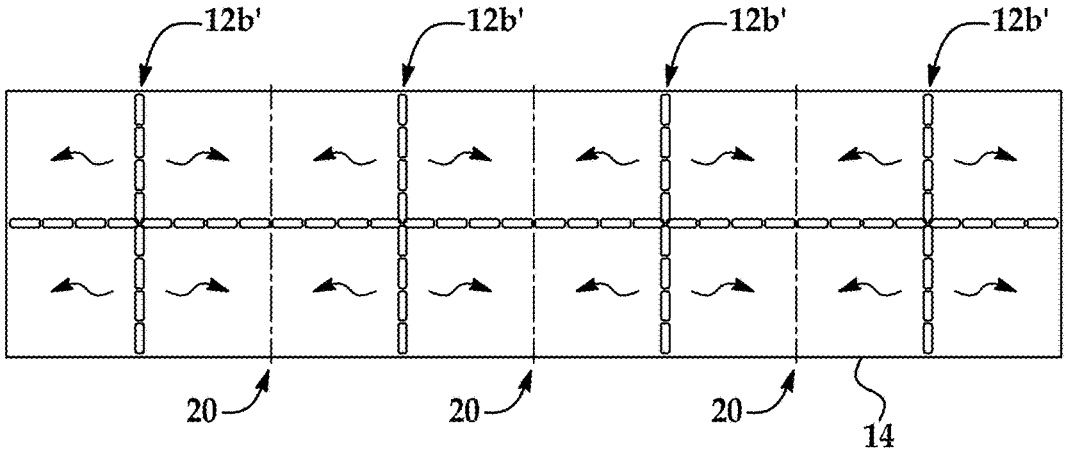
FIG. 4 is a schematic diagram illustrating an overhead view of a parallel-plate wavefront progression for H-polarization.

FIG. 4 shows an exemplary overhead illustration of the Hpol wavefront progression for a coupling structure 12b (which includes a slot transition 12b') and a full-sized Ku-band parallel plate 14. A first wavefront emanates from four vertical waveguide feed-to-parallel plate slot transition arrays 12b', and wavefronts from each slot transition array 12b' then propagate both to the left and right of the parallel plate 14. The E-field orientations for this wavefront within the parallel plate 14 form virtual shorts 20 (areas where the electric field is zero due to symmetry conditions) at midway points between each adjacent pair of slot arrays 12b'.

Figure 5:
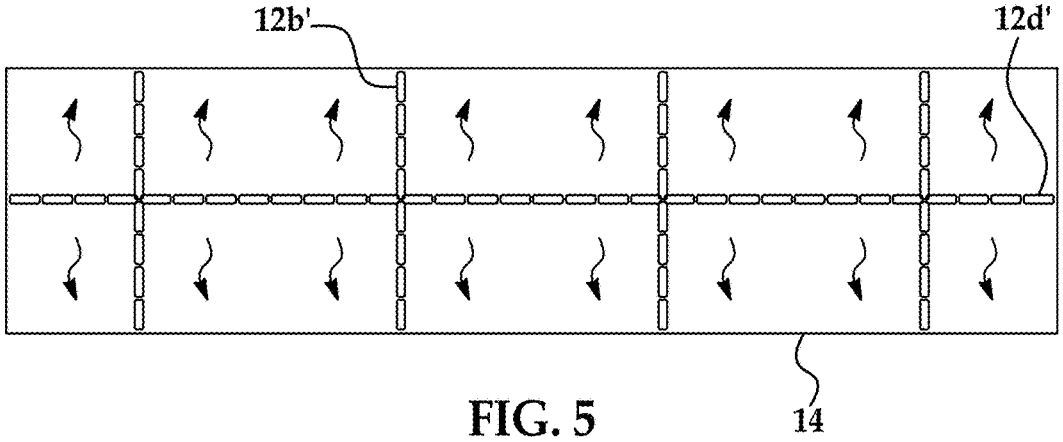
FIG. 5 is a schematic diagram illustrating an overhead view of parallel-plate wavefront progression for V-polarization.

FIG. 5 illustrates the corresponding orthogonal Vpol wavefront progression through the same example parallel plate 14. This second orthogonal wavefront emanates from a single horizontal array of slots 12d' located along the horizontal centerline of the parallel-plate, and then propagates to the top and bottom directions within the parallel plate 14. Both sets of wavefronts (Hpol and Vpol) then form separate (orthogonal) standing wave distributions inside the parallel plate 14 before eventually radiating out through the CTS radiators 16, which are arranged above the parallel plate 14. Each wavefront in the dielectric within the parallel plate 14 is comprised of multiple simultaneous modes, which all propagate at different phase velocities. As the wavefronts propagate within the parallel plate 14, their shape and content will evolve based on the modal content of each wavefront under the influence of the perimeter boundary conditions.

Figure 6A:
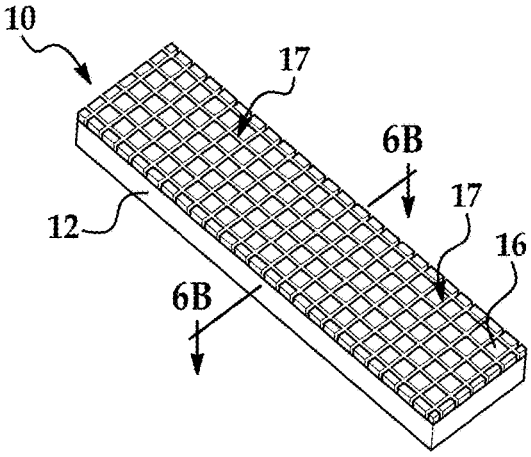
FIG. 6A is a top perspective view of an exemplary single-level parallel-plate structure with single stage CTS radiators (stubs) that may be used in the antenna of FIG. 1.
Figure 6B:
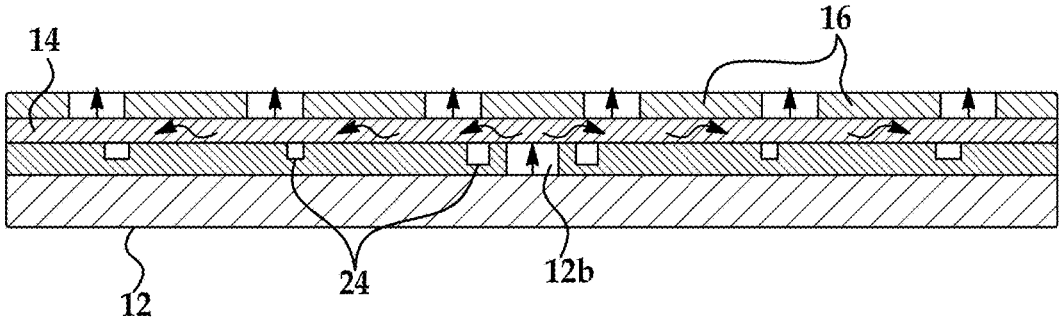
FIG. 6B is a cross-section of an exemplary single-level parallel-plate structure with single stage CTS radiators (stubs) that may be used in the antenna of FIG. 1.

The parallel plate 14 of the antenna 10 can be arranged into single level layouts as shown in FIGS. 6A-6B for ease of manufacturing when the operating bandwidth is small (e.g., between 0-15%, when operating bandwidth is defined as $f_{max}-f_{min}$ and $(f_{max}-f_{min})/f_{center}$ is less than 15%). As used herein, a "single level" refers to an antenna 10 that includes one parallel plate region arranged relative to the feed network 12 and the pucks 16 defining the CTS radiators 17. As illustrated in FIGS. 6A and 6B, a feed network 12 is coupled to a parallel plate region 14 via a waveguide-to-parallel plate transition 12b. Pucks 16, which may be rectangular in shape, are arranged on one side of the parallel plate region 14 and define CTS radiators 17 through which signals may propagate. The parallel plate region 14 may include one or more tuning grooves 24 having the same or different dimensions. The tuning grooves 24 can create a desired level of reflected energy of the signal injected from the waveguide feed network 12 that produces a desired (well-matched) characteristic as the signal exits the CTS radiators 17.

Figure 7:
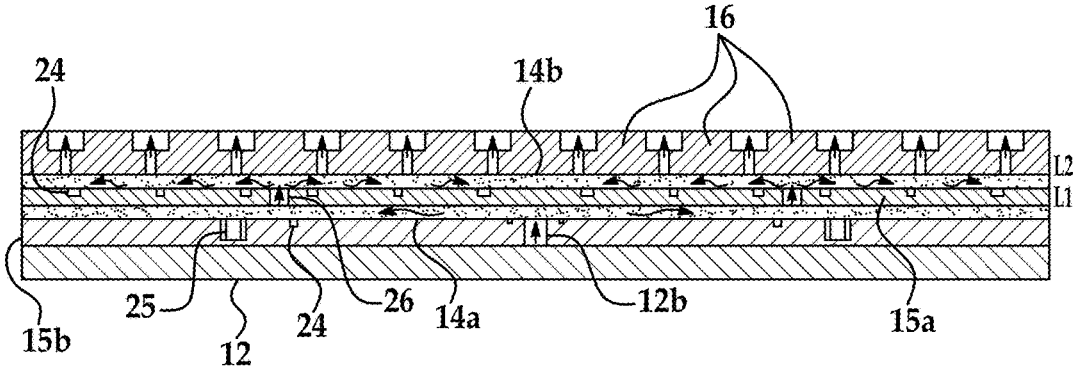
FIG. 7 is a cross-section of an exemplary two-level parallel-plate structure with two-stage CTS radiators (stubs) that may be used in the antenna of FIG. 1.

If broader bandwidth is desired, a two-level layout as shown in FIG. 7 can be used to increase the bandwidth of 40% or larger (up to a 2:1 bandwidth). As can be seen in FIG. 7, the two-level layout includes two separate parallel-plate regions 14a, 14b arranged relative to the feed network 12 and the aperture level pucks 16 (the second parallel-plate region being between the first plate structure 15a and the second plate structure 15b), the regions between adjacent pucks 16 defining the CTS radiators 17 through which the signals may propagate. The parallel-plate regions 14a and 14b, which each include tuning grooves 24 and resonators 25, are coupled to one another via parallel-plate layer transitions 26 (e.g., vertically-oriented parallel plate connecting the horizontally-oriented parallel plate regions 14a and 14b) formed by gaps between lower level pucks 27 that are dimensionally larger and fewer in quantity as compared to CTS radiator pucks. The tuning grooves 24 and resonators 25 effect the transition from the first parallel-plate region 14a to the second parallel-plate region 14b. Even more bandwidth (>80%) can be realized with more elaborate, multi-level fractal-like designs such as the Ku-band variant shown in FIG. 8, which includes three parallel plate regions 14*a*, 14*b* and 14*c* arranged in a stacked configuration, with layer transitions 26 connecting adjacent parallel-plates.

Figure 8:
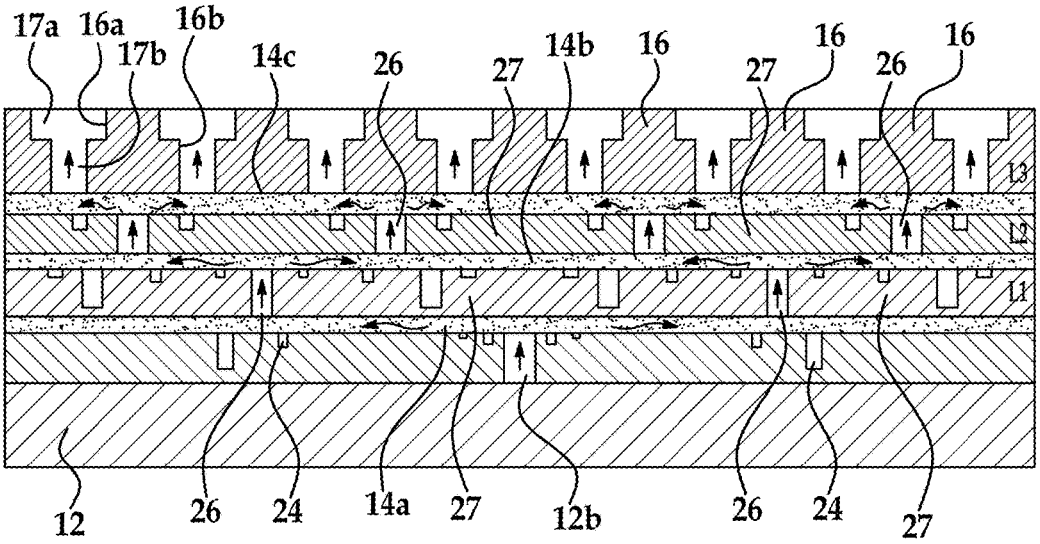
FIG. 8 is a cross-section of an exemplary multi-level fractal parallel-plate structure with two-stage CTS radiators (stubs) that may be used in the antenna of FIG. 1.

FIGS. 6-8 also illustrate the cross-sectional progression of each wavefront as it propagates through parallel plate structures 14 of different sizes (one, two, or more levels). The transverse tuning grooves 24 cut into the parallel plate structures 14 at each level and serve a number purposes including acting as chokes and/or virtual shorts, enhancing antenna match and boosting coupling into the CTS radiators (stubs) 17 defined by the pucks 16. Collectively, this network contained within the parallel-plate 14 helps set the aperture distribution that is ultimately radiated out from the top of the aperture (the apertures being defined by the pucks 16).

Arranged above the parallel plate 14 are a rectangular lattice of CTS radiator pucks 16 which define the common CTS aperture 17. Wavefronts provided by the first and second coupling structures propagate within the parallel-plate region and radiate to free-space through the common aperture (or in the reverse, signals received by the common aperture propagate within the parallel-plate region and are provided to the first and second coupling structures). The pucks 16 may have a narrow first stage 16*a* that opens up into a wider second stage 16*b* (thereby defining the radiator 17 having a wide first stage 17*a* and a narrow second stage 17*b*), where the space between the pucks 16 defines the aperture 17. While a two-stage configuration is illustrated, a single stage configuration or a configuration with three or more stages may be employed. The pucks 16, which may be formed from metal or metalized plastic (referred to as metallic members), help transition the standing wave distributions inside the parallel plate 14 into free space to form the far-field antenna pattern. The spacing between pucks 16 can either be fixed (identical) or variable in both dimensions in order to provide a good impedance match and to achieve a desired taper and radiation pattern.

Figure 9:
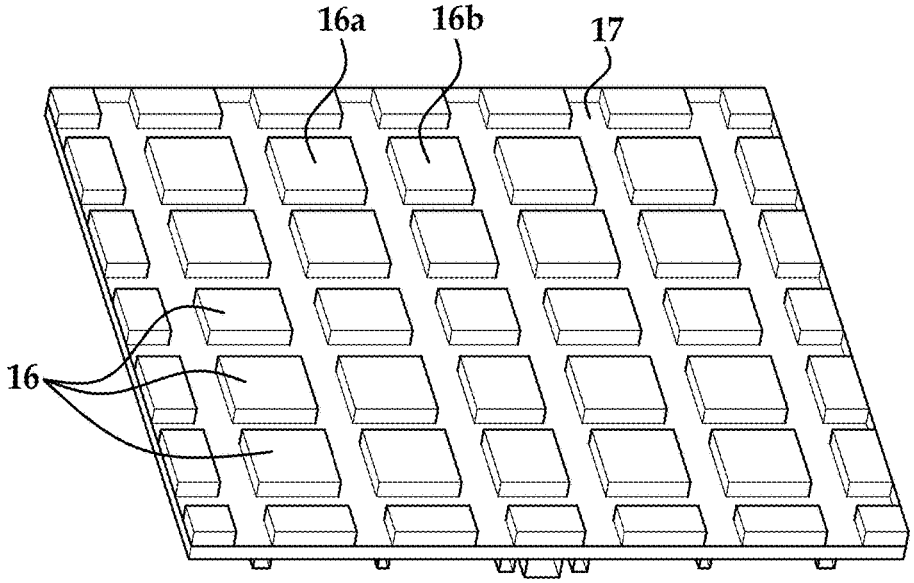
FIG. 9 is a perspective view of exemplary single level CTS puck radiators arranged in a two-dimensional grid that may be used in the antenna of FIG. 1.
Figure 10:
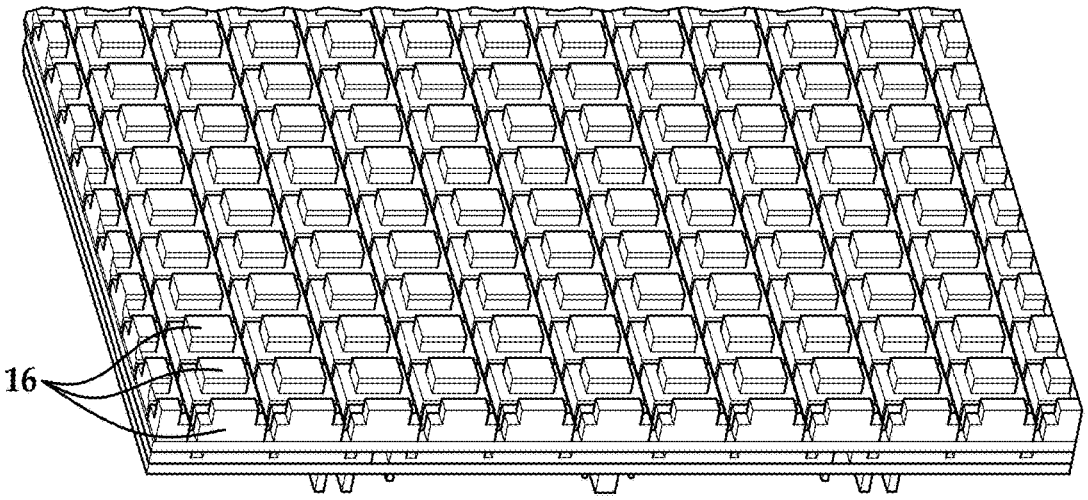
FIG. 10 is a perspective view of exemplary two-level CTS puck elements, the uppermost composed of two-stage CTS puck radiators, arranged in a two-dimensional grid that may be used in the antenna of FIG. 1.
Figure 11:
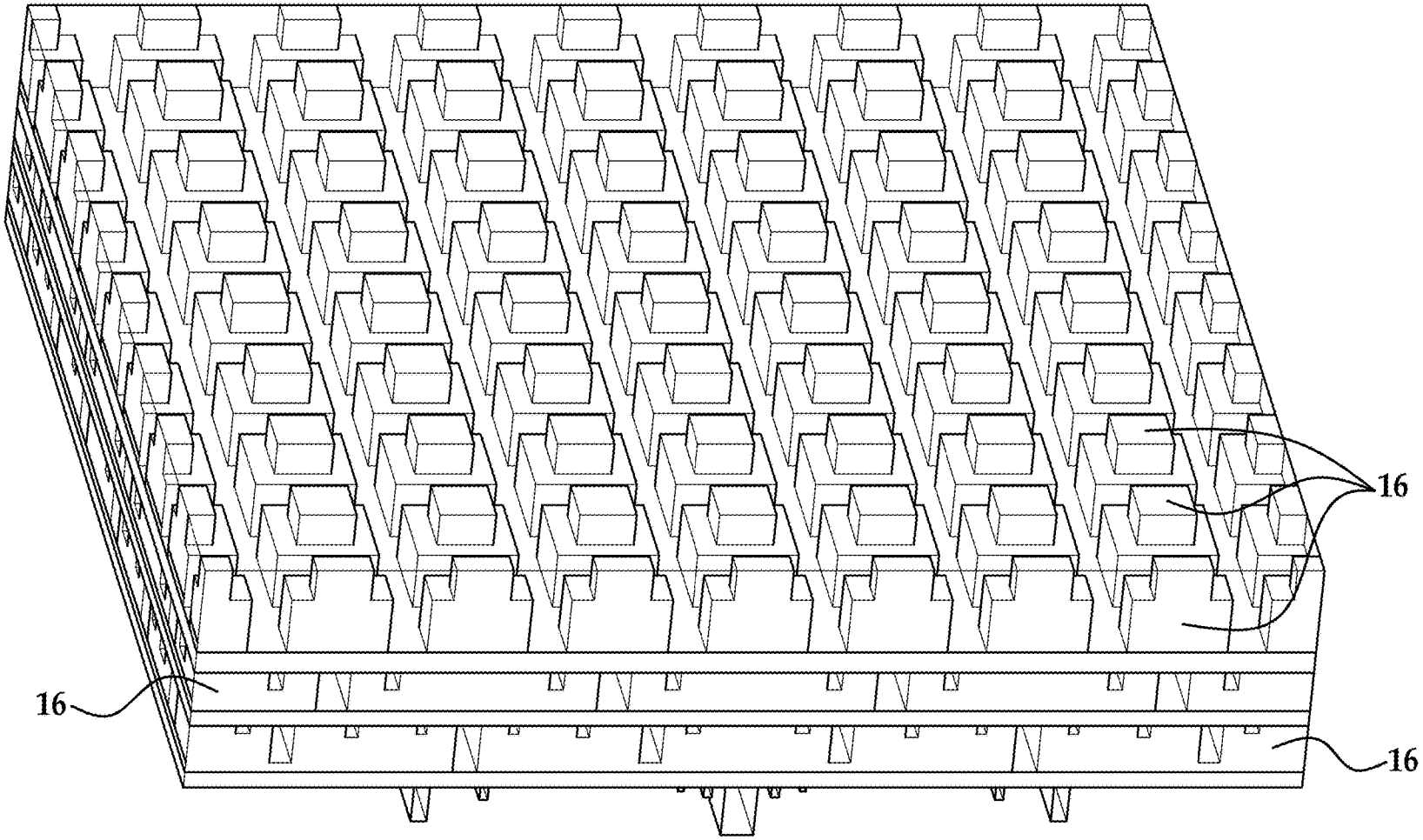
FIG. 11 is a perspective view of exemplary multi-level CTS puck elements, the uppermost composed of two-stage CTS puck radiators, arranged in a two-dimensional grid that may be used in the antenna of FIG. 1.
Figure 12:
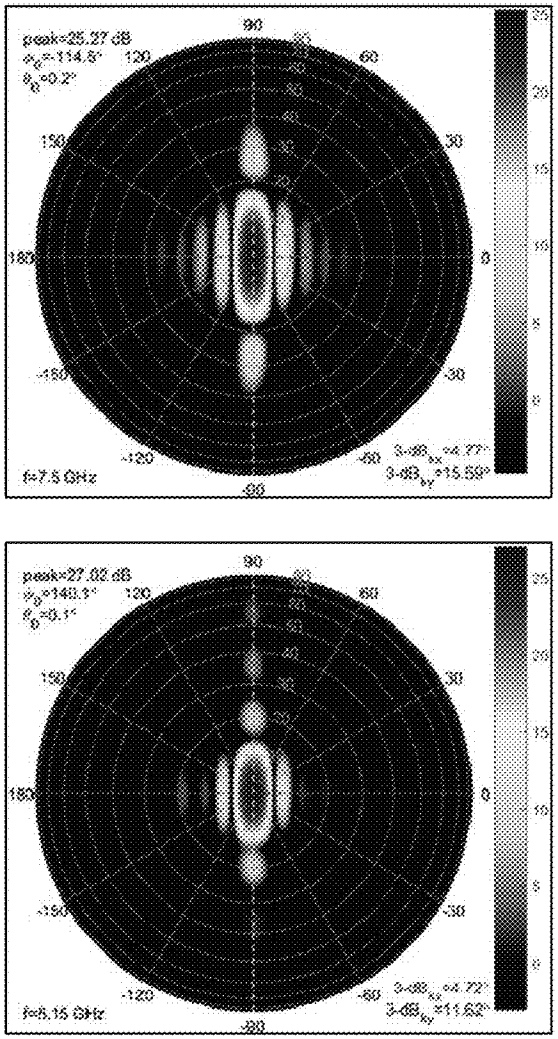
FIG. 12 illustrates the VSWR (voltage standing wave ratio)/patterns for a single level, one polarization per band antenna in accordance with the present invention.
Figure 12:
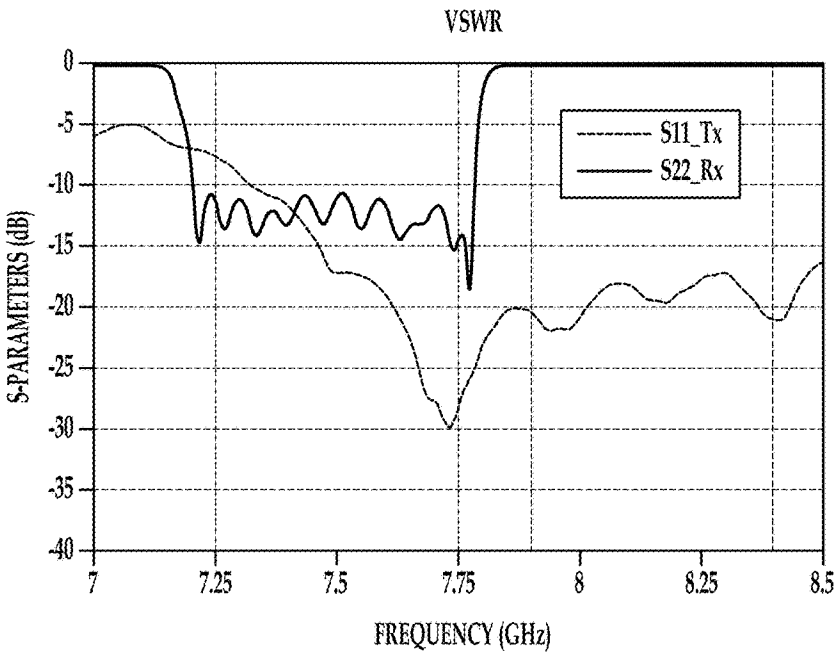
Figure 13:
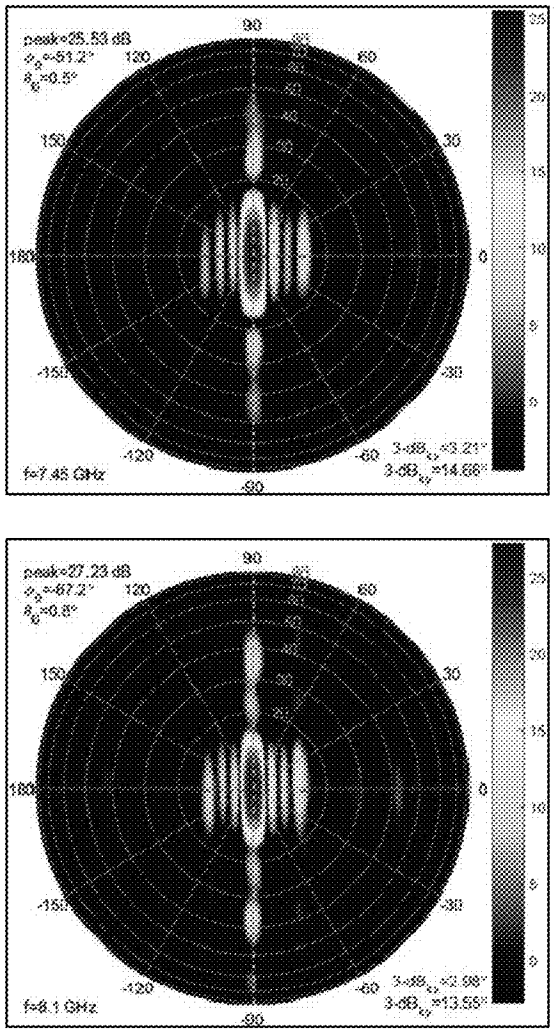
FIG. 13 illustrates the VSWR/patterns for a single level, two polarizations per band antenna in accordance with the present invention.
Figure 13:
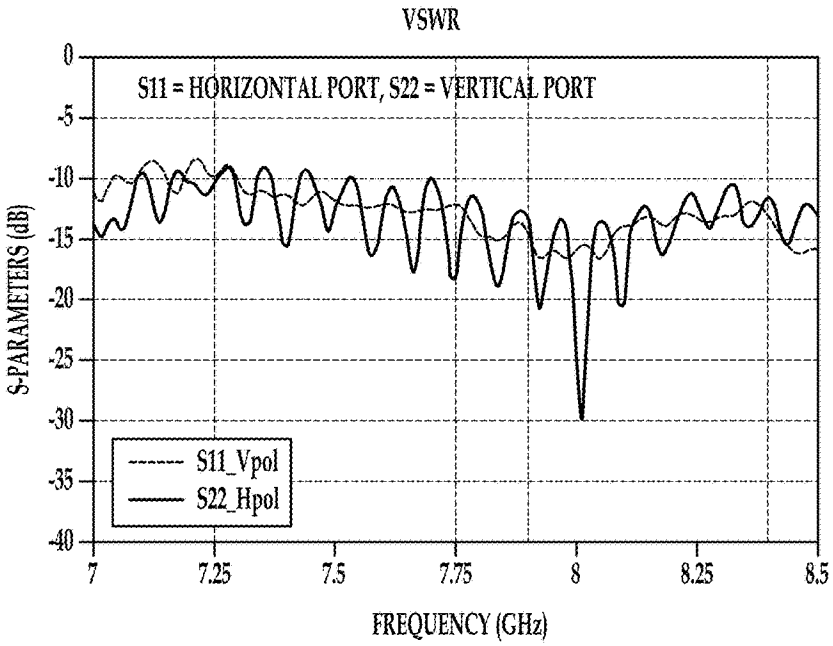
Figure 14:
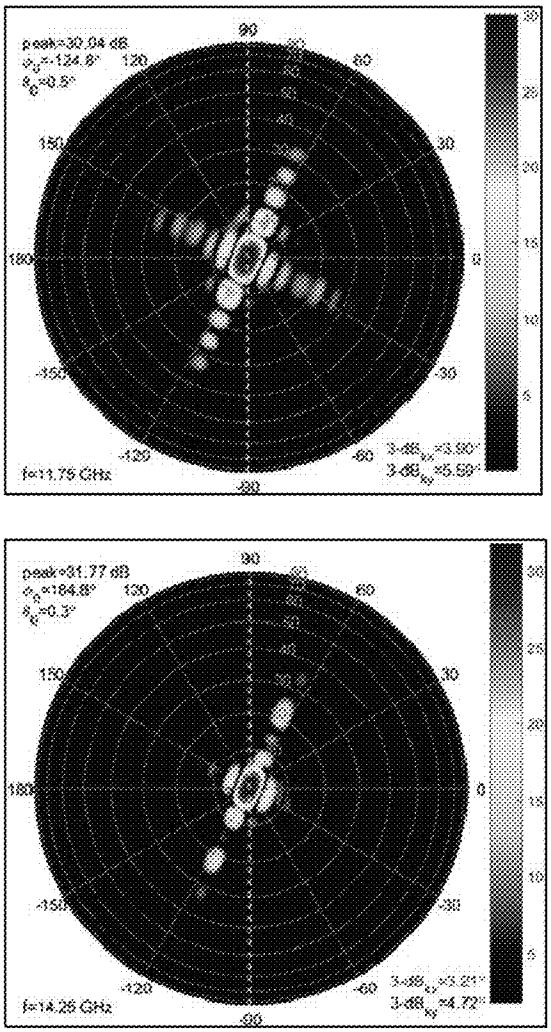
FIG. 14 illustrates the VSWR/patterns for a multi-level, one polarization per band antenna in accordance with the present invention.
Figure 14:
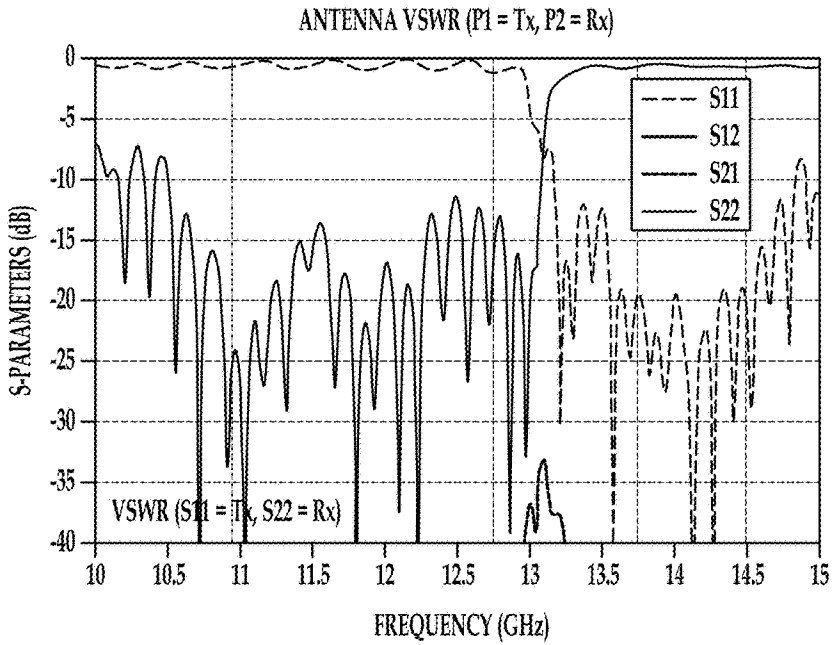

An example isometric view of a realized X-band, single level subarray lattice of pucks 16 with both unequal puck sizes (pucks 16*a* having different dimensions from pucks 16*b*) and unequal radiator spacings (due to the different puck sizes) is shown in FIG. 9. Isometric views of more broadband two- and three-level puck radiator layouts are shown in FIGS. 10 and 11, respectively. These isometric views correspond to the cross-sections shown in FIGS. 6, 7 and 8, respectively.

Each wavefront within the parallel-plate 14 is strongly influenced by transverse edges of the radiators defined by the CTS pucks 16, while being mostly transparent to the opposite orthogonal edge of the same pucks 16. The pucks 16 act as an impedance transformer and radiator, where the placement of the pucks form the air space that defines the radiators. Preferably, the pucks are designed to match the impedance of the combined layers. In this regard, the width of the pucks provide optimal coupling to the lower section of the puck and is designed to efficiently launch a signal from the parallel-plate region. The height of the pucks can be based on frequency bands of the structure to obtain as wide of a frequency band as possible. The puck radiator design can also depend on additional factors such as overall antenna sizing, Rx/Tx frequency band assignments, mechanical spacing constraints, and achievable coupling levels through individual radiators. The horizontal/transverse extent of each stage of the radiator (defined as the "gap" region between adjacent pucks) is selected in order to provide optimal impedance matching between the impedance associated with the parallel-parallel plate region and the effective radiator impedance (set generally by the puck-to-puck spacing). The vertical extent of each stage of the radiator (formed by adjacent pucks) is generally set to approximately $0.2\lambda_{mid}$, where $\Delta_{mid}$ is the wavelength associated with the mid-frequency of the overall desired operating frequency range. The lowest stage (closest to the parallel-plate region) is generally selected to provide the desired internal coupling required to provide optimal impedance match of the composite subarray as seen from the feed network.

An additional region which may be present in some dual-pol CTS architectures is the polarizer 18. The polarizer's function is to adapt the CTS radiator's native linear polarization to match a satellite's or other communication link's incoming polarization. Each telecommunications band has its own spectrum and polarization convention, so CTS antennas can employ a wide variety of polarizer types across different communications bands.

Several key attributes make a dual-pol CTS antenna in accordance with the invention very easy to adapt to a wide variety of communications bands. These attributes are discussed below.

Bandwidth Adaptability: The dual-pol CTS architecture is scalable to a variety of frequency bandwidths. Single layer implementations can provide up to ~15% bandwidth, while offering the lowest overall height profile and easiest assembly integration. Two-layer configurations have realized ~25% bandwidths, and even wider bandwidths in excess of 80% bandwidth have been realized by distributing the CTS radiators into multi-level "fractal" feed layers (i.e., a pattern, such as a binary doubling pattern, that repeats at every scale, effectively doubling at each level). The tremendous bandwidth capability of "fractal" feed layers makes it possible to reuse the same physical aperture space for frequency band pairings spaced far apart (e.g., K/Q-Band) that is conventionally covered via separate physical apertures.

Polarization Diversity: The natural polarization output by a dual-pol CTS antenna in accordance with the invention is linear horizontal/vertical polarization, but this native polarization is easily adapted to a variety of other polarization combinations. For example, using an orthomode transducer (OMT) to combine the separate HN channels enables tracking linear polarization to be achieved. Likewise, using a meanderline polarizer layer above the CTS aperture enables separate circular polarization channels (e.g., LH/RH or RH/LH). Finally, dual-simultaneous CP can be accomplished by combining the two orthogonal components together with a waveguide quadrature coupler.

The dual-pol CTS antenna in accordance with the invention features many novel attributes distinguishing it from traditional antenna designs. These features can include one or more of the following items.

True Shared Aperture: The full aperture is used for both bands and both polarizations. This reduces overall system footprint compared to antennas utilizing separate Rx and Tx apertures to achieve the same band/polarization diversity.

Low Dissipative Losses: The transmission line media used within dual-pol CTS antennas are all very low loss. Waveguides used in the feed networks offer exponentially lower loss than alternative printed circuit technologies such as microstrip and stripline. The waveguide can be split along its broadwall to help minimize leakage while still enabling ease of fabrication and assembly. Likewise, the parallel plate dielectric material is typically a low-density foam (though other homogeneous and inhomogeneous embodiments employing dielectric and/or air are practical) which provides ample structure and support for the CTS radiator puck 16 arrangements while enabling low-loss parallel-plate mode propagation. Together, these features lead to reduced dissipative losses and enhanced overall efficiency compared to competing antenna architectures.

Excellent Cross-Pol Suppression: The parallel plate modes utilized in the device in accordance with the invention transition out to free space via long continuous CTS radiators rather than discrete elements. These slot-like radiators can be viewed as a series of filamentary magnetic current sources, which are known for their excellent cross-pol suppression. This quality is further enhanced when arrayed, resulting in a very pure co-polarized signal. Typical cross-pol suppression offered by dual-pol CTS antennas is >25 dB. Competing shared aperture technologies fare much worse (as low as 10 dB). Low isolation reduces the data throughput that can be pushed through the antenna and in some cases, satellite operators will not even allow an antenna to be deployed if minimum cross-pol requirements are not met.

Excellent Tx-Rx and/or Polarization Isolation: Despite Rx and Tx channels sharing the same physical modal excitation space and aperture, the wavefronts for each channel are isolated from each other either by physical separation of the waveguides 12, or by orthogonality between each set of structures (tuning grooves, and CTS slot radiators) within the parallel plate 14. This orthogonality allows the features for each channel to be designed independently of the other and maintain good polarization isolation from the other channel when integrated into the shared common aperture. Most communication bands assign a different polarization to each frequency band assignment so Rx and Tx bands will naturally be isolated from each other. Maintaining orthogonality within the physical structures of the antenna serves to further enhances this isolation.

Inexpensive to Fabricate: Features utilized in the construction of the dual-pol CTS antenna 10 are adaptable to a variety of manufacturing techniques including low-cost construction methods. The waveguide feed structures 12 that lead into the parallel plate region 14 can be split along the waveguide's broadwall a-dimension (E-plane feed) to minimize losses as well as to reduce precision machining costs, or can be in the form of an H-plane feed. Alternatively, these waveguide feed networks may be stamped out of plastic and copper plated for high-volume, low-cost manufacturing. Tuning features in the open parallel plate region are passive and suitable for injection-molded plastic manufacturing. Finally, the CTS radiators (defined by the pucks 16) are very simple rectangular structures laid out into regular two-dimensional lattice arrangements. The pucks 16 can be machined, dye-cast, plastic injection molded, or even extruded to reduce production costs.

Compact Highly Integrated Planar Structure: The dual-pol CTS antennas discussed here can have a low-profile rectangular footprint with a flat planar aperture face. The X- and Ku-Band versions are particularly well-suited for vehicular communications-on-the-move applications when paired with an Az-over-El gimbal. Dual-pol CTS antennas can be shaped to have a much larger width-to-height aspect ratio to enable lower vehicle drag, as well as to present a narrower Azimuth GeoPlane beamwidth under typical (low to moderate) skew angles.

Better Amplitude/Phase Control with Better Efficiency: Traditional dish/reflector-based antennas require costly precision machining processes in order to shape the main beam. In contrast, a dual-pol CTS antenna 10 in accordance with the invention enables easier control of the aperture's amplitude and phase characteristics through direct design control of its constituent waveguide feed 12, parallel plate 14, and radiating puck 16 structures. Additionally, the dual-pol CTS antenna 10 offers improved efficiency since the CTS radiating aperture directly generates its far-field antenna pattern. This is in direct contrast to dish antennas where the reflector responsible for generating a dish's antenna patterns is illuminated by a separate feed horn. The spillover loss from this secondary illumination leads to reduced antenna efficiency.

Figure 15:
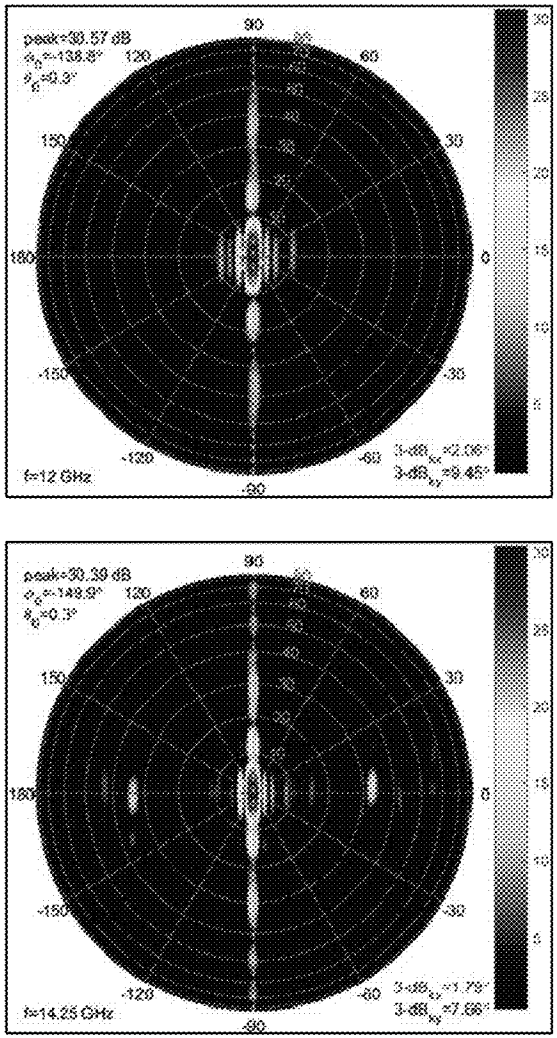
FIG. 15 illustrates the VSWR/patterns for a multi-level, two polarizations per band antenna in accordance with the present invention.
Figure 15:
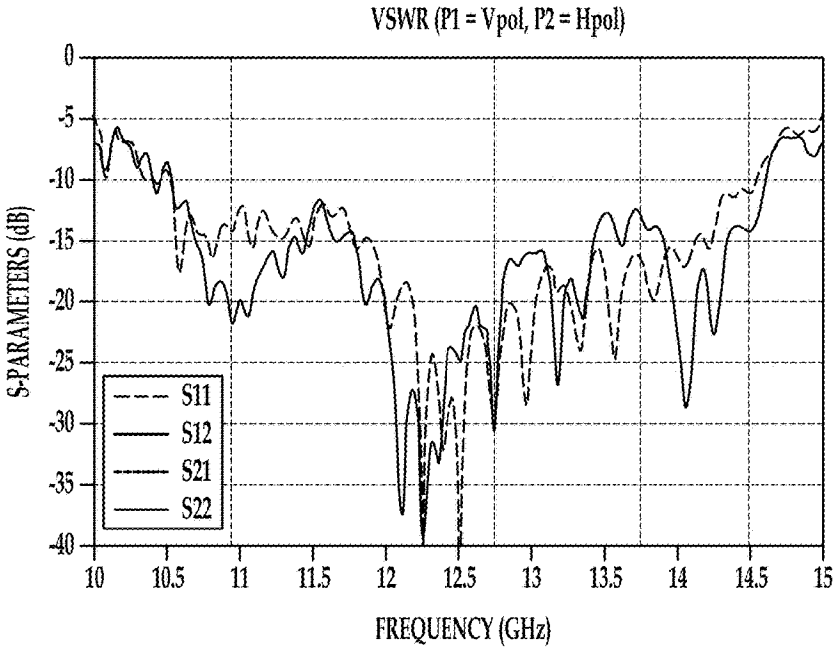

Cleaner Radiation Patterns: A benefit of better amplitude/phase control is the resulting improvement in radiation pattern quality. Traditional dish-based antennas generate sidelobes in all directions regardless of the pattern cut being presented to the GeoPlane, due to the monotonic way the feed horn illuminates the reflector along all skew cuts. In contrast, the aperture illumination on the face of the dual-pol CTS aperture emanates centrally from orthogonal sets of slots, and taper off towards the perimeter. This feeding approach leads to cleaner intercardinal regions and much cleaner far-field radiation patterns devoid of sidelobes and grating lobes in the intercardinal planes. Representative dual-band pattern sets for various dual-pol CTS antenna concepts in accordance with the invention are shown FIGS. 12-15. The much cleaner patterns provided by dual-pol CTS antennas can be exploited in satellite applications to minimize adjacent satellite interference (ASI) by physically rotating the antenna in conjunction with adjusting the polarization to move the two principal sidelobe planes of the antenna away from the Geostationary Satellite Plane. This is demonstrated by the radiation pattern shown in FIG. 15.

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

What is claimed is:

1. A multi-polarized continuous transverse stub (CTS) antenna, comprising:

a first feed network operative to at least one of receive or transmit a RF signal having a first linear polarization;

a second feed network oriented geometrically orthogonal from the first feed network and operative to at least one of receive or transmit an RF signal having a second linear polarization, generally with an orthogonal polarization relative to the first polarization;

at least one parallel-plate region defined by a first plate structure and a second plate structure spaced apart from the first plate structure;

a first coupling structure connecting the first feed network to the parallel-plate region;

a second coupling structure connecting the second feed network to the parallel-plate region; and a common aperture arranged on one side of the parallel-plate region, wherein generally orthogonal wavefronts produced by the first and second coupling structures and propagated within the parallel-plate region radiate to free-space through the common aperture.

2. The CTS antenna according to claim 1, further comprising a plurality of pucks spaced apart from one another, wherein the space between adjacent pucks defines the common aperture.

3. The CTS antenna according to claim 2, wherein the plurality of pucks comprise a plurality of metallic members arranged in a lattice.

4. The CTS antenna according to claim 1, wherein the plurality of pucks are rectangular in shape.

5. The CTS antenna according to claim 1, wherein at least one puck of the plurality of pucks is dimensioned different from at least one other puck of the plurality of pucks.

6. The CTS antenna according to claim 1, wherein the first and second coupling structures are connected to the parallel-plate region on a side of the parallel-plate region opposite the common aperture.

7. The CTS antenna according to claim 6, wherein the first and second coupling structures are coupled to the second plate structure, and the common aperture is formed in the first plate structure.

8. The CTS antenna according to claim 1, wherein the parallel-plate region comprises a plurality of parallel plate regions located between the common aperture and the first and second coupling structures, whereby each adjacent parallel plate region further couples the wavefronts within such parallel-plate region to the next adjacent parallel plate region via parallel plate layer transitions.

9. The CTS antenna according to claim 1, further comprising a polarizer arranged adjacent to the common aperture and operative to change a polarization of the radiated antenna patterns.

10. The CTS antenna according to claim 1, wherein the at least one parallel-plate region comprises a dielectric material arranged between the first plate structure and the second plate structure.

11. The CTS antenna according to claim 10, wherein the dielectric material comprises at least one of a foam material or air.

12. The CTS antenna according to claim 1, wherein the first feed network and the second feed network comprise at least one of a waveguide, a strip line, a suspended air stripline, or a microstrip transmission line.

13. The CTS antenna according to claim 1, wherein the first and second coupling structures comprise waveguide-to-parallel-plate slot transitions.

14. The CTS antenna according to claim 1, wherein the first polarization comprises vertical polarization and the second polarization comprises horizontal polarization.

15. The CTS antenna according to claim 1, wherein the parallel-plate region comprises at least one groove arranged in a surface of one of the first plate structure or the second plate structure.

* * * * *